United States Patent [19]

Kato

[11] 4,386,761

[45] Jun. 7, 1983

[54] BALUSTER

[75] Inventor: Chizuo Kato, Tokyo, Japan

[73] Assignee: Aluteck Co., Ltd., Tokyo, Japan

[21] Appl. No.: 219,522

[22] Filed: Dec. 23, 1980

[30] Foreign Application Priority Data

Sep. 22, 1980 [JP] Japan ..... 55-135177[U]

[51] Int. Cl.[3] ..... E04H 17/16; E04H 17/14

[52] U.S. Cl. ..... 256/21; 256/59

[58] Field of Search ..... 256/21, 22, 59, 65, 256/67, 24, 73

[56] References Cited

U.S. PATENT DOCUMENTS 2,558,142 6/1951 Lapp et al. ..... 256/21

2,969,955 1/1961 Newman ..... 256/21

FOREIGN PATENT DOCUMENTS 941025 11/1963 United Kingdom ..... 256/59

1169889 11/1969 United Kingdom ..... 256/22

*Primary Examiner*—Richard J. Scanlan, Jr.

*Attorney, Agent, or Firm*—Scrivener, Clarke, Scrivener and Johnson

[57] ABSTRACT

Balusters for building the balustrades of stairs, verandas or the like, in which baluster bars are telescopically inserted into a main body so that the positions of the baluster bars relative to the main body can be adjusted depending upon the distance between top and bottom rails or the like and/or the slope thereof, whereby the baluster can be easily and quickly joined between the top and bottom rails or the like.

1 Claim, 2 Drawing Figures

BALUSTER

BACKGROUND OF THE INVENTION

The present invention relates to a baluster for balustrades of stairs, verandas or the like.

In general, the balusters for balustrades of stairs and verandas are in size from 850 to 1100 mm, but especially the slopes of stairs are not standardized because they change from one building to another so that the standardization of the balusters used for constructing the stair balustrades has been very difficult.

The present invention was made to overcome the above and other problems encountered in the prior art balusters and has for its object to provide balusters which can be used to build a balustrade or the like in any size and slope. The above and other objects, effects and advantages of the present invention will become more apparent from the description of a preferred embodiment thereof taken in conjunction with the accompanying drawings.

DETAILED DESCRIPTION OF A PREFERRED EMBODIMENT

Figure 1:
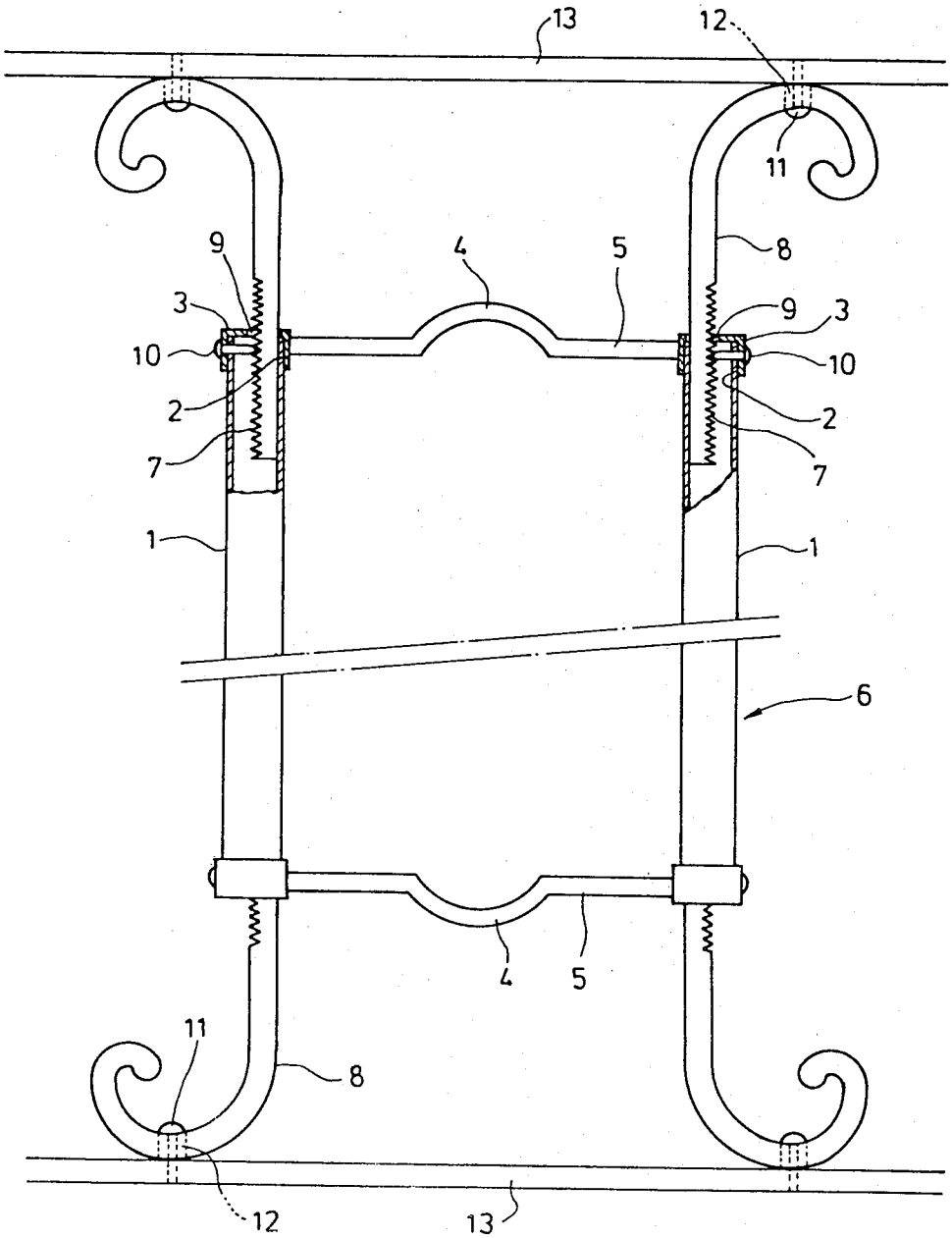
FIG. 1 is a front view, partly in section, of a preferred embodiment of a baluster in accordance with the present invention.

Referring first to FIG. 1, a baluster in accordance with the present invention includes a baluster main body 6 comprising a pair of baluster hollow bodies 1 which are in parallel with each other, spaced apart by a predetermined distance and interconnected by a pair of connecting members 5 each having a curved or bowed portion 4. More specifically, each connecting member 5 has sockets 3 which are U shaped in cross section as shown at 2 and fitted over the top or bottom ends of the baluster hollow bodies 1, whereby the latter are interconnected. Thus the main body 6 is in the form of a rectangular frame.

The baluster further includes baluster bars or posts 8 which are substantially similar in construction and are telescopically inserted into the hollow bodies 1. Since these baluster bars 8 and their associated parts are similar in construction and mode of operation, it will suffice to explain only one baluster bar 8 and its associated parts. The baluster bar 8 consists of a curved supporting portion and an upright portion one side of which is formed with a series of teeth 7. The curve supporting portion is provided with an axially elongated mounting hole 12 at the vertex and a screw or bolt 11 is extended through this mounting hole 12 and screwed into the top or bottom rail 13 upon the installation of the baluster.

The top or bottom of the socket 3 of the connecting member 5 is formed with a through hole 9 which is located closer to the end of the connecting member 5 and whose opening area is slightly greater than the dimension of the baluster bar 8. The baluster bar 8 is telescopically inserted into the hollow body 1 through this hole 9. Tapped holes are extended through the walls of the socket 3 and the hollow body 1 in opposed relationship with the series of teeth 7 of the baluster bar 8 and a positioning screw 10 is screwed into these holes for engagement with the teeth 7.

Referring still FIG. 1, the method for installing the baluster with the above-described construction between the horizontal top and bottom rails 13 will be described. In this case, from the standpoint of the outer appearance, it is preferable that the main body 6 is equally spaced apart from both the top and bottom rails 13. To this end, the upper and lower baluster bars 8 must be equally extended out of the hollow bodies 1. First the upper and lower baluster bars 8 are withdrawn from or inserted into the hollow bodies 1 so that they are extended from the upper and lower ends of the hollow bodies 1 by a predetermined distance. Then the line connecting between the vertexes of the upper or lowered curved portions of the baluster bars 8 becomes horizontal. Thereafter the positioning screws 10 are tightened so as to securely engage with the teeth 7 of the baluster bars 8, whereby the bars 8 are securely held in position. Thus the baluster with the height corresponding to the vertical distance between the top and bottom rails 13 is provided.

Thus prepared baluster is placed between the top and bottom rails 13 so that the vertexes of the curved supporting portions are made into close contact with the top and bottom rails 13. Next the setscrews 11 are tightened, whereby the balusters can be securely joined to the top and bottom rails 13. Instead of the screws or bolts 11, any other suitable fastening and joining means such as ropes and adhesives may be employed.

An alternative installation method is such that first the baluster bars 8 are securely joined or fastened to the top and bottom rails 13. Next the main body 6 is moved upward or downward so that it may be located at the position equally spaced apart from the top and bottom rails 13 and then the positioning screws 10 are tightened.

Figure 2:
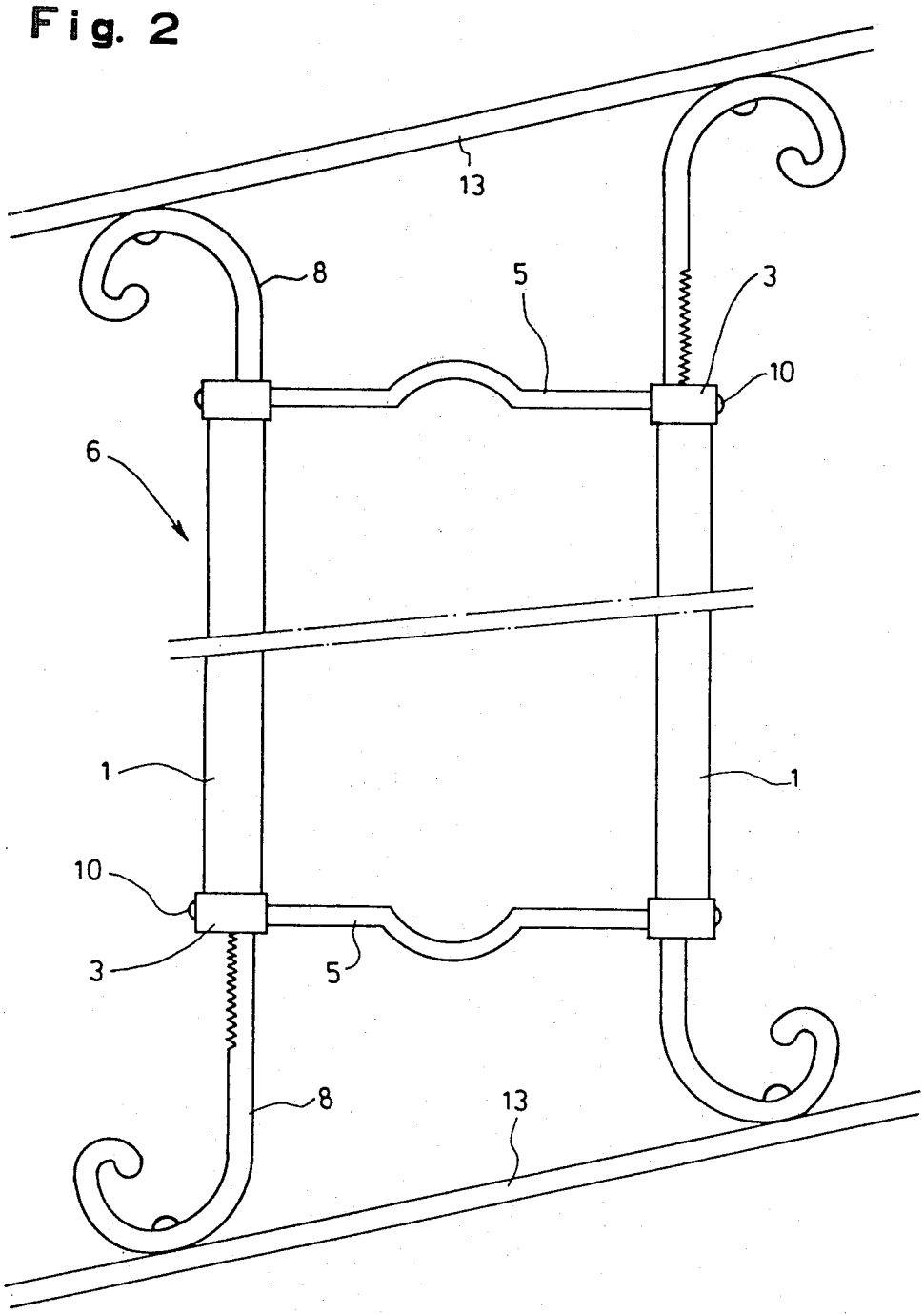
FIG. 2 shows the baluster installed between the top and bottom rails which are inclined at an angle relative to the horizontal.

Next referring to FIG. 2, the method for installing the baluster between the parallel top and bottom rails 13 which are inclined at an angle relative to the horizontal will be described. First the upper right baluster bar 8 is extended while the upper left baluster bar 8 is retracted as shown so that the line connecting between the vertexes of the curved supporting portions of the right and left baluster bars 8 is inclined at the same angle as that of the top rail 13. Thereafter, the positioning screws 10 are tightened so that the baluster bars 8 can be securely held in position. In like manner, the lengths of the lower baluster bars 8 can be adjusted.

Thus prepared baluster is installed between the top and bottom rails 13 and securely joined thereto in the manner described previously. In this case, the points of contact between the curved supporting portions of the baluster bars 8 and the top and bottom rails 13 are different from those shown in FIG. 1, but the mounting holes 12 are axially elongated as described previously so that the screws or bolts 11 can be screwed to the top and bottom rails 13 without any interference.

As described above, the baluster in accordance with the present invention can be easily and quickly installed between the top and bottom rails 13 even when they are inclined at an angle relative to the horizontal.

Furthermore, according to the present invention, the main body 6 is in the form of a rectangular frame so that any desired decorative objects can be attached to it, whereby the outer appearance of the baluster may be much enhanced.

The balusters in accordance with the present invention can be used in building the balustrades of stairs and verandas, the torii, the gates, the copings and other structures.

The present invention may be modified in various manners without departing from the true spirit thereof. For instance, it may be omitted to provide the series of teeth 7 on the baluster bars 8. Instead of the shape of the parts shown in FIGS 1 and 2, they may be designed and constructed in any desired shape.

In summary, according to the present invention, the individual baluster bars 8 are telescopically inserted into or withdrawn from the hollow bodies 1 so that the height of the baluster can be adjusted depending upon the distance between the top and bottom rails. In addition, the baluster bars 8 have the curved supporting portions so that even when the top and bottom rails 13 are inclined, the baluster bars 8 can be snugly made into contact with the top and bottom rails. Thus, the balusters in accordance with the present invention can be installed very easily and quickly.

What is claimed is:

1. A baluster in the form of an open frame comprising a pair of hollow bodies which extend vertically and are spaced apart from each other, a pair of spaced members connecting said hollow bodies betweeen the upper and lower ends of said bodies, a U-shaped socket member fitted over the corresponding ends of said hollow bodies, said U-shaped sockets being provided with an opening in the base of the U, baluster bars comprising a curved supporting portion and a straight portion integral therewith, the straight portion of each baluster bar being telescopically inserted in the opening formed in the base of the U-shaped member and into the baluster hollow bodies at the corresponding end of the latter and means mounted on said hollow bodies for securely holding the straight portion of the baluster bar in position.

* * * * *